US009669272B2

(12) United States Patent
Park et al.

(10) Patent No.: US 9,669,272 B2
(45) Date of Patent: Jun. 6, 2017

(54) GOLF CLUB HEAD

(71) Applicant: DUNLOP SPORTS CO. LTD., Kobe-shi, Hyogo (JP)

(72) Inventors: Sharon J. Park, Irvine, CA (US); Brian D. Schielke, Los Angeles, CA (US); Kevin R. Tassistro, Escondido, CA (US)

(73) Assignee: DUNLOP SPORTS CO., LTD., Kobe-shi (JP)

( * ) Notice: Subject to any disclaimer, the term of this patent is extended or adjusted under 35 U.S.C. 154(b) by 218 days.

(21) Appl. No.: 14/341,354

(22) Filed: Jul. 25, 2014

(65) Prior Publication Data

US 2014/0335972 A1 Nov. 13, 2014

Related U.S. Application Data

(63) Continuation of application No. 13/047,246, filed on Mar. 14, 2011, now Pat. No. 8,821,307.

(51) Int. Cl.
*A63B 53/04* (2015.01)
*A63B 53/06* (2015.01)

(52) U.S. Cl.
CPC ..... *A63B 53/06* (2013.01); *A63B 53/04* (2013.01); *A63B 53/047* (2013.01); *A63B 53/0475* (2013.01); *A63B 2053/0408* (2013.01); *A63B 2053/0433* (2013.01)

(58) Field of Classification Search
USPC ..... 473/324–350
See application file for complete search history.

(56) References Cited

U.S. PATENT DOCUMENTS

| | | | |
|---|---|---|---|
| 645,942 | A | 3/1900 | Cran |
| 1,135,621 | A | 4/1915 | Roberts et al. |
| 1,306,029 | A | 6/1919 | Robertson |
| 1,319,233 | A | 10/1919 | Mattern |
| 1,320,163 | A | 10/1919 | Fitz Maurice |
| 1,988,043 | A | 1/1935 | Lard |
| 2,328,583 | A | 9/1943 | Reach |
| 2,332,342 | A | 10/1943 | Reach |
| 2,360,364 | A | 10/1944 | Reach |
| 2,451,262 | A | 10/1948 | Watkins |
| 3,190,651 | A | 6/1965 | Thomas |
| 3,220,733 | A | 11/1965 | Saleeby |

(Continued)

FOREIGN PATENT DOCUMENTS

| | | |
|---|---|---|
| JP | A-10-155948 | 6/1998 |
| JP | A-2004-267460 | 9/2004 |

(Continued)

*Primary Examiner* — Alvin Hunter
(74) *Attorney, Agent, or Firm* — Oliff PLC

(57) ABSTRACT

A golf club head includes a primary component and a secondary component, wherein the secondary component is rotatably or pivotally associated with the rear surface of the primary component. The secondary component is adjustable between a first orientation and a second orientation relative to the primary component such that the golf club head has a first sole contour when the secondary component is in the first orientation and a second sole contour when the secondary component is in the second orientation, the first sole contour being different from the second sole contour.

10 Claims, 20 Drawing Sheets

(56) References Cited

U.S. PATENT DOCUMENTS

| | | | |
|---|---|---|---|
| 3,419,275 | A | 12/1968 | Winkleman |
| 3,680,868 | A | 8/1972 | Jacob |
| 4,340,230 | A | 7/1982 | Churchward |
| 4,630,825 | A | 12/1986 | Schmidt et al. |
| 4,708,347 | A | 11/1987 | Kobayashi |
| 4,852,880 | A | 8/1989 | Kobayashi |
| 5,213,329 | A | 5/1993 | Okumoto et al. |
| 5,275,413 | A | 1/1994 | Sprague |
| 5,297,794 | A | 3/1994 | Lu |
| 5,386,996 | A | 2/1995 | Hiruta et al. |
| 5,435,551 | A | 7/1995 | Chen |
| 5,439,223 | A | 8/1995 | Kobayashi |
| 5,776,010 | A | 7/1998 | Helmstetter et al. |
| 5,803,830 | A | 9/1998 | Austin et al. |
| 5,807,186 | A | 9/1998 | Chen |
| 5,833,551 | A | 11/1998 | Vincent et al. |
| 5,938,540 | A | 8/1999 | Lu |
| 6,093,112 | A | 7/2000 | Peters et al. |
| 6,183,376 | B1 | 2/2001 | Peters et al. |
| 6,200,228 | B1 | 3/2001 | Takeda |
| 6,358,158 | B2 | 3/2002 | Peters et al. |
| 6,422,950 | B1 | 7/2002 | Whitlam |
| 6,554,719 | B2 | 4/2003 | Peters et al. |
| 6,569,029 | B1 | 5/2003 | Hamburger |
| 6,638,183 | B2 | 10/2003 | Takeda |
| 6,709,345 | B2 | 3/2004 | Iwata et al. |
| 6,921,344 | B2 | 7/2005 | Gilbert et al. |
| 7,004,848 | B2 | 2/2006 | Konow |
| 7,131,913 | B2 | 11/2006 | Iwata et al. |
| 7,309,295 | B2 | 12/2007 | Solari |
| 7,335,112 | B1 | 2/2008 | Bitondo |
| 7,588,503 | B2 | 9/2009 | Roach et al. |
| 7,934,999 | B2 | 5/2011 | Cackett et al. |
| 8,012,034 | B1 | 9/2011 | Cackett et al. |
| 8,033,931 | B2 | 10/2011 | Wahl et al. |
| 8,123,626 | B2 | 2/2012 | Cackett et al. |
| 8,221,258 | B2 | 7/2012 | Cackett et al. |
| 8,262,496 | B1 | 9/2012 | Cackett et al. |
| 8,821,307 | B2 * | 9/2014 | Park ..... A63B 53/04 473/244 |
| 2003/0139226 | A1 | 7/2003 | Cheng et al. |
| 2005/0143190 | A1 | 6/2005 | Takeda |
| 2007/0155534 | A1 | 7/2007 | Tsai et al. |
| 2007/0281796 | A1 | 12/2007 | Gilbert et al. |
| 2013/0324276 | A1 | 12/2013 | Stites et al. |

FOREIGN PATENT DOCUMENTS

| | | |
|---|---|---|
| JP | A-2007-029494 | 2/2007 |
| JP | A-2007-319687 | 12/2007 |
| JP | A-2008-036315 | 2/2008 |
| JP | A-2008-272274 | 11/2008 |
| JP | A-2008-272496 | 11/2008 |
| JP | A-2009-112800 | 5/2009 |
| JP | A-2009-189687 | 8/2009 |
| JP | A-2010-148652 | 7/2010 |
| JP | A-2010-148653 | 7/2010 |
| JP | A-2011-229914 | 11/2011 |
| JP | A-2012-061095 | 3/2012 |
| JP | A-2012-192179 | 10/2012 |

* cited by examiner

GOLF CLUB HEAD

This is a Continuation of application Ser. No. 13/047,246, filed Mar. 14, 2011. The prior applications, including the specifications, drawings and abstracts are incorporated herein by reference in their entirety.

COPYRIGHT AUTHORIZATION

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

Certain club specifications, e.g., bounce angle, may be crucial to achieving shot consistency and are generally dictated by the swing type and physical characteristics of the player. Accordingly, players must be properly fitted to optimize these parameters in their iron sets and to obtain maximum performance from their equipment. During the fitting process, club specifications for the entire set are typically determined by evaluating a player's swing using, e.g., a plurality of 7 irons, wherein each test iron has a distinct set of specifications. However, the excessive number of clubs required to perform a proper fitting may be expensive and cumbersome to transport.

Moreover, playing conditions may also have a profound effect on a player's shot consistency during a golf round. For example, when the golf course is wet, the golf club head has a greater tendency to dig into the ground during a golf swing, which may alter the shot trajectory. To accommodate adverse playing conditions, manufacturers have provided golf club heads that have adjustable components, e.g., interchangeable soles. However, adjusting these components can be difficult and time consuming.

SUMMARY

The present invention, in one or more aspects thereof, may comprise a golf club head that promotes a more efficient club fitting process, improved club head longevity, and enhanced club options for a golf round.

In one example, a golf club head according to one or more aspects of the present invention may include a primary component, having a strike face with a front surface, a rear surface behind the front surface, and a secondary component, pivotally associated with the rear surface of the strike face. The secondary component is adjustable between a first orientation and a second orientation relative to the primary component such that the golf club head has a first sole contour when the secondary component is in the first orientation and a second sole contour when the secondary component is in the second orientation. The first sole contour is different from the second sole contour.

In another example, a golf club head according to one or more aspects of the present invention may include a primary component comprising a strike face having a front surface with a leading edge, a rear surface behind the front surface of the strike face, and a hosel having a hosel centerline. A secondary component is pivotally associated with the rear surface of the primary component, and the secondary component includes an axis of rotation located in an imaginary vertical face plane, substantially perpendicular to an imaginary hosel plane. The axis of rotation is located a distance Y from an imaginary line, substantially parallel to the axis of rotation, passing through the leading edge of the golf club head, and located in the imaginary vertical face plane, with the golf club head in a reference position. The golf club head further includes a sole height and a bounce angle between about 2° and about 20°, wherein:

$$(0.7)\cdot\text{sole height}\cdot\cos(\text{bounce angle})\leq Y\leq 2.0\cdot\text{sole height}\cdot\cos(\text{bounce angle}).$$

In another example, a golf club head according to one or more aspects of the present invention may include a heel, a toe, and a primary component comprising a strike face having a leading edge and a plurality of score lines, a rear surface behind the front surface, and a hosel having a hosel centerline. A secondary component is pivotally associated with the rear surface of the primary component and includes an axis of rotation located in an imaginary vertical face plane, substantially perpendicular to an imaginary vertical hosel plane. The axis of rotation is located a distance X from an imaginary vertical toe plane, substantially perpendicular to the hosel plane and passing through the furthest laterally projecting toe point of the golf club head. The secondary component further includes a width W characterized as the shortest distance between a first imaginary vertical plane, substantially perpendicular to the front surface of the strike face and passing through the furthest laterally projecting point of the secondary component proximate the heel, and a second imaginary vertical plane, substantially perpendicular to the front surface of the strike face and passing through the furthest laterally projecting point of the secondary component proximate the toe, with the golf club head oriented such that the strike face is substantially vertical and the score lines are substantially horizontal. Moreover, the golf club head satisfies the relationship: $0.3\ W\leq X\leq 0.7\ W$.

In yet another example, a golf club head according to one or more aspects of the present invention may include a heel, a toe, and a primary component comprising a strike face with a face center, a leading edge, and a plurality of score lines, a rear surface behind the front surface, and a hosel having a hosel centerline. A secondary component is pivotally associated with the rear surface of the primary component and includes an axis of rotation located in an imaginary vertical face plane, substantially perpendicular to an imaginary vertical hosel plane. The axis of rotation is located a distance X from an imaginary vertical toe plane, substantially perpendicular to the hosel plane and passing through the furthest laterally projecting toe point of the golf club head. The face center is located a distance C from the imaginary vertical toe plane when the golf club head is in the reference position, the distance X the distance C.

In yet another example, a golf club head according to one or more aspects of the present invention may include a primary component, comprising a strike face having a front surface, a rear surface behind the front surface, and a secondary component. The golf club head may further include a means for joining the secondary component to the primary component and a means for biasing the secondary component away from the rear surface of the golf club head.

These and other features and advantages of the golf club head according to the invention in its various aspects, as provided by one or more of the examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

Exemplary implementations of the present invention will now be described with reference to the accompanying drawings, wherein.

DETAILED DESCRIPTION

The following detailed description includes references to the accompanying drawings, which form a part of the detailed description. The drawings show, by way of illustration, specific embodiments in which the golf club head may be practiced. These embodiments, which are also referred to herein as "examples" or "options," are described in enough detail to enable those skilled in the art to practice the present invention. Structural elements of each embodiment may be combined, other embodiments may be utilized, or structural or logical changes may be made without departing from the scope of the invention. The following detailed description is, therefore, not to be taken in a limiting sense and the scope of the invention is defined by the appended claims and the legal equivalents of the features recited herein.

For clarity, the definitions used herein are interpreted with reference to one or more aspects of the invention characterized in relation to FIGS. 1-4 and 11-15 of the drawings. However, those skilled in the art will appreciate that such definitions also apply to same or similar aspects of the invention described throughout the specification in connection with the remaining drawing figures.

In this document, the terms "a" or "an" are used to include one or more, and the term "or" is used to refer to a nonexclusive "or" unless otherwise indicated. In addition, it is to be understood that the phraseology or terminology employed herein, and not otherwise defined, is for the purpose of description only and not of limitation.

Figure 1:
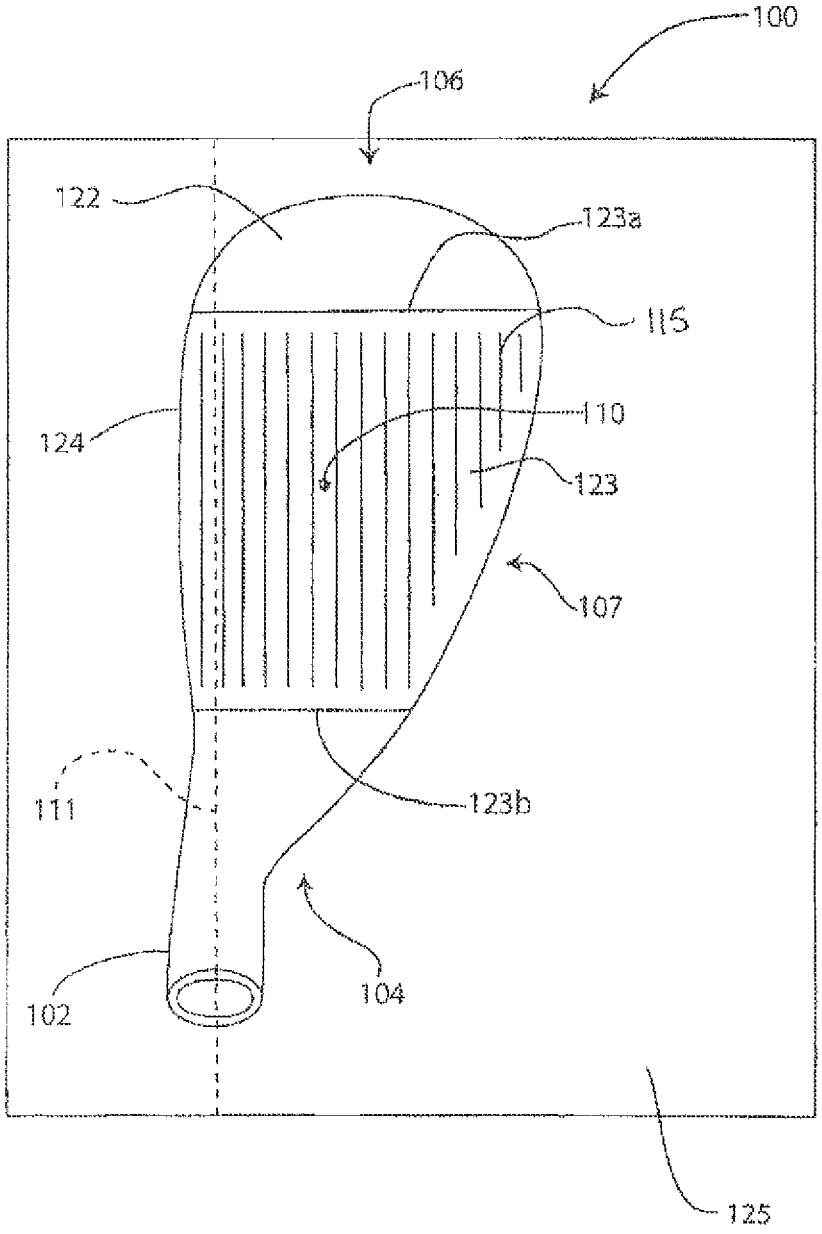
FIG. 1 is a top plan view of a golf club head in the reference position according to one or more aspects of the present invention.
Figure 2:
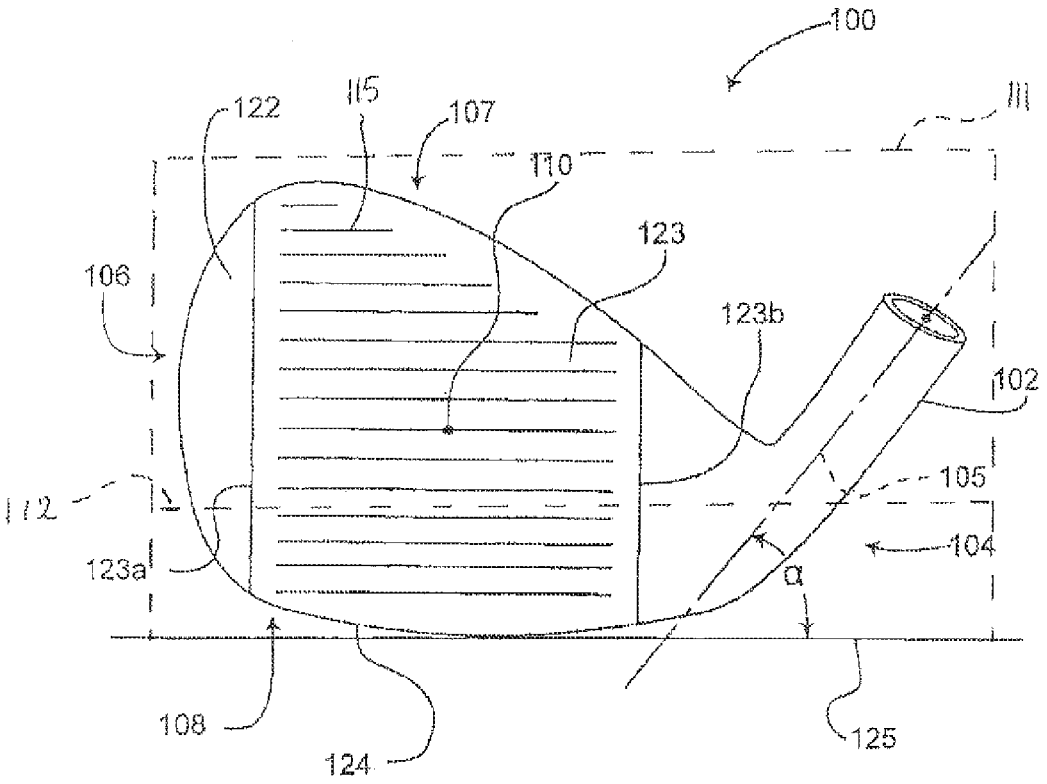
FIG. 2 is a front elevational view of the golf club head of FIG. 1.

Referring to FIGS. 1 and 2, a club head 100, shown in the "reference position" (defined immediately below) may comprise a toe portion 106, a heel portion 104, a hosel 102 having a central axis (centerline) 105, a top line portion 107, a sole portion 108, and a front surface 122. The front surface 122 includes a face center 110, a leading edge 124, a plurality of score-lines 115, and a strike face 123, delimited by boundaries 123*a* and 123*b*.

"Reference position", as used herein, denotes a position of the club head relative to an imaginary horizontal ground plane 125, where the hosel centerline 105 is oriented at the club head's actual lie angle $\alpha$ with respect to the horizontal ground plane 125 and lies in an imaginary vertical hosel plane 111, which contains an imaginary horizontal line 112, generally parallel to the front surface 122 of the golf club head 100.

Figure 3:
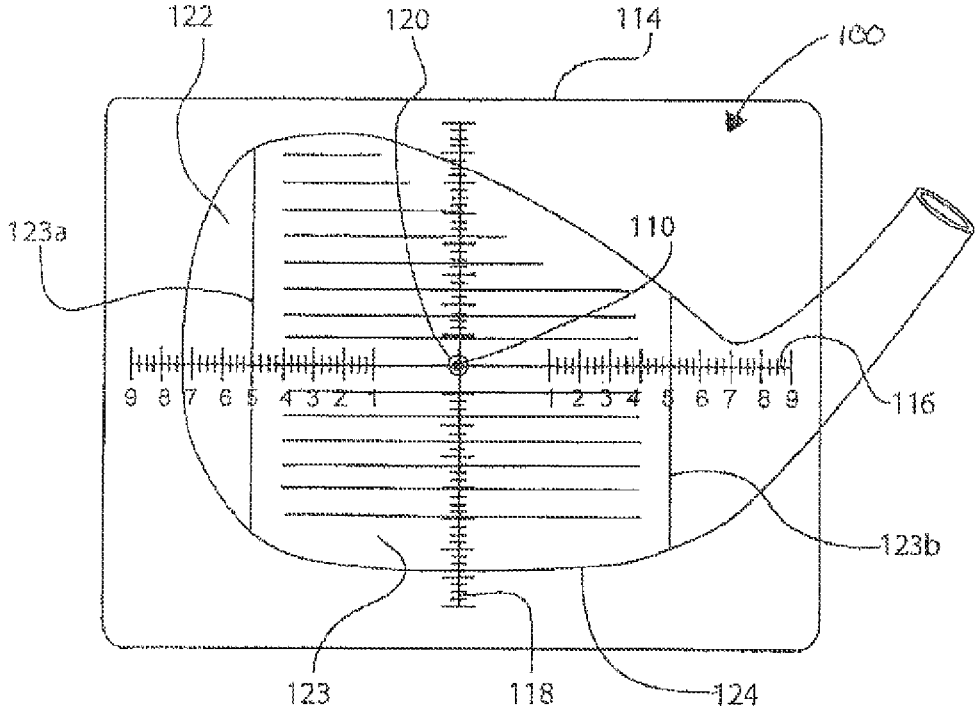
FIG. 3 is a front elevational view of the golf club head of FIG. 1, with a face-center locating template applied thereto.

Referring to FIGS. 2 and 3, "face center", e.g., the face center 110, as used herein, is located using a template 114, having a coordinate system with a heel-toe axis 116 orthogonal to a top-bottom axis 118. An aperture 120 is disposed at the origin of the coordinate system and the axes are graduated into evenly spaced increments. The template 114 may be made of a flexible material, e.g., a polymer, and may be transparent.

The location of the face center 110 is determined as follows. The template 114 is initially applied to the front surface 122 so that the aperture 120 is approximately in the middle of the front surface 122 and the heel-toe axis 116 is generally parallel to the line 112. The template is then translated in the heel-toe direction along the front surface 122 until the heel and the toe measurements along the axis 116 at the opposite boundaries (123*a* and 123*b*) of the striking face 123 have the same absolute value. Once the template 114 is centered with respect to the front surface 122 in the heel-toe direction, the template is translated in the top-bottom direction along the front surface until the measurements along the axis 118 at the opposite edges of the striking face 123 have the same absolute value. The above sequence is repeated until the absolute value of the heel measurement along axis 116 is equal to that of the toe measurement and the absolute value of the bottom measurement along axis 118 is equal to that of the top measurement. A point is then marked on the front surface through the aperture 120 to designate the face center 110.

A locating template, such as the template 114, is referenced in the United States Golf Association's Procedure for Measuring the Flexibility of a Golf Clubhead (Revision 2.0, Mar. 25, 2005) and is available from the USGA.

Figure 4:
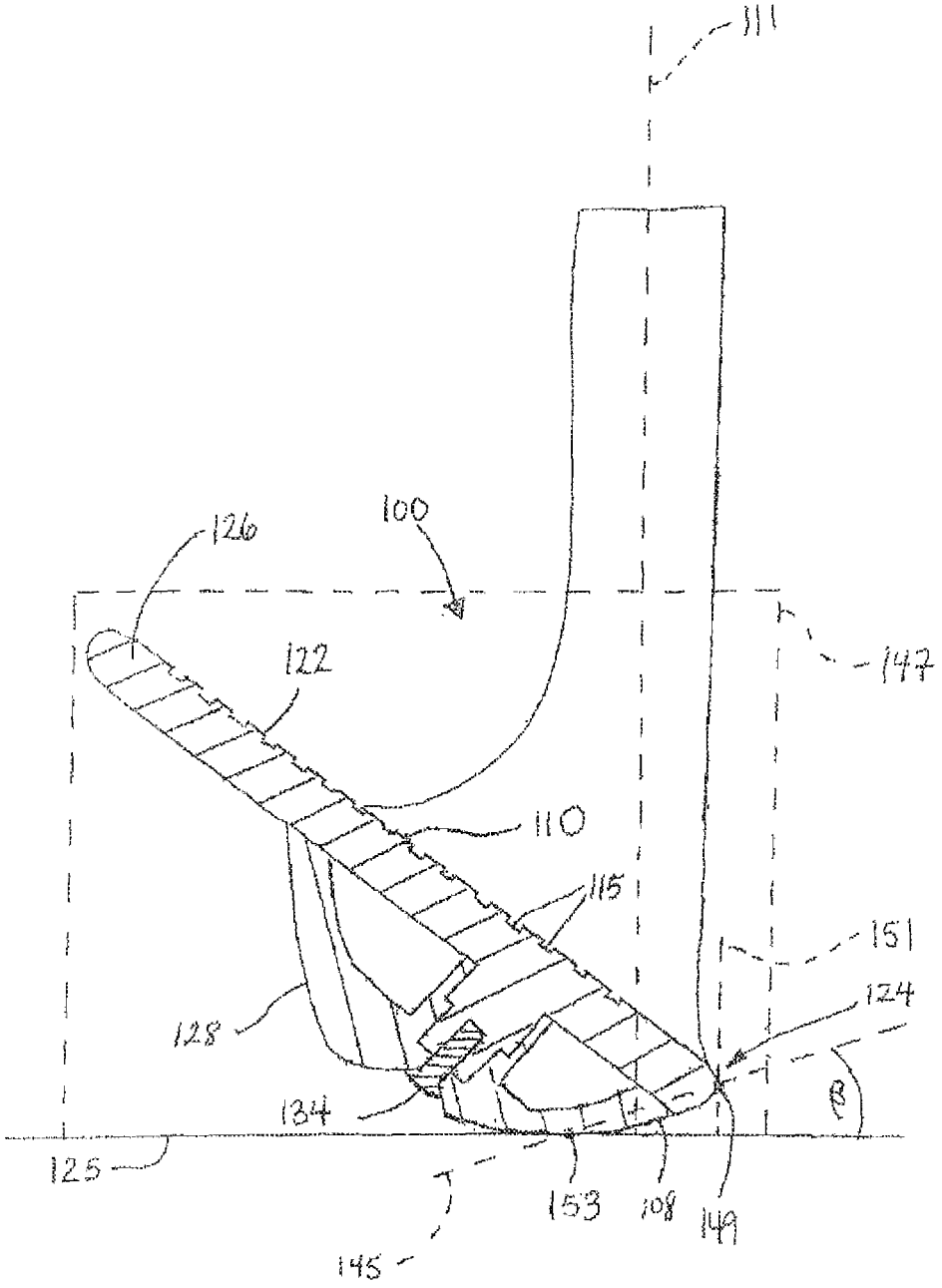
FIG. 4 is a toe-side cross-sectional view of the golf club head of FIG. 1, according to one or more aspects of the present invention.

Referring to FIG. 4, "bounce angle" of the club head 100 in the reference position, e.g., bounce angle β, denotes an angle, in an imaginary vertical center plane 147 passing through the face center 110 and substantially perpendicular to the hosel plane 111, between an imaginary line 145, located in the center plane 147, and a ground plane 125. The imaginary line 145 passes through a sole point 153, characterized as the lowermost point of the sole portion 108 in the center plane 147, and a point of tangency 149 of an imaginary vertical line 151, located in the center plane 147, to the leading edge 124 of the golf club head 100.

Figure 11:
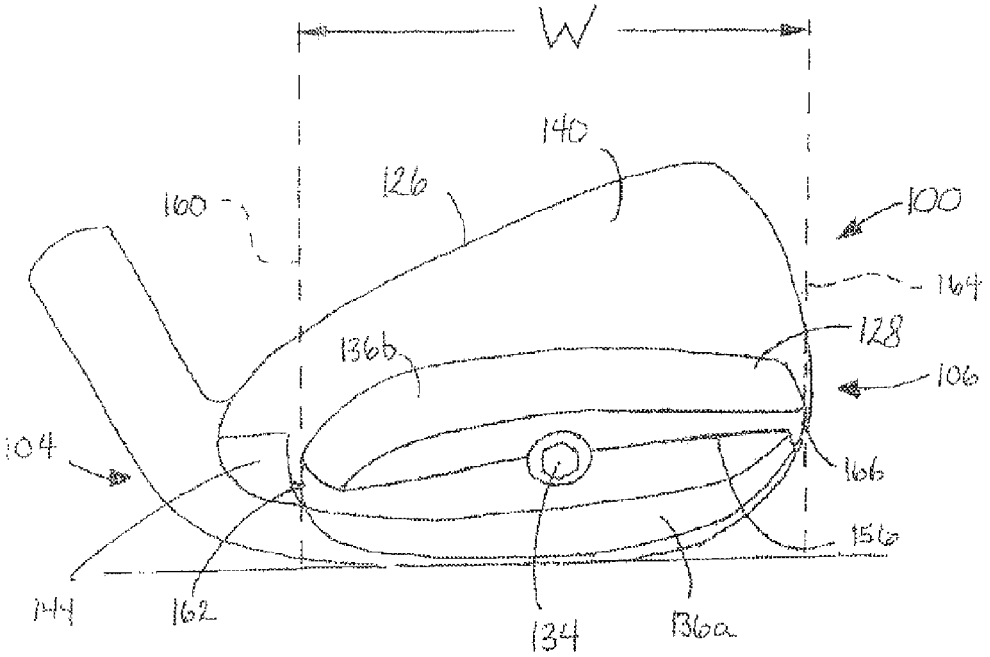
FIG. 11 is a rear perspective view of the golf club head of FIG. 4 with its face in the drawing plane.

Referring to FIG. 11, when the club head 100 is rotated from the reference position relative to a horizontal axis, normal to the center plane 147, so that the front surface (not shown) is vertical, the secondary component 128, in either the first or the second orientation, has a width W, characterized as the shortest distance between a first imaginary vertical plane 160, perpendicular to the front surface 122 (not shown) and passing through the furthest laterally projecting point 162 of the secondary component 128 proximate the heel 104, and a second imaginary vertical plane 164, perpendicular to the front surface (not shown) and passing through the furthest laterally projecting point 166 of the secondary component proximate the toe 106.

Figure 12:
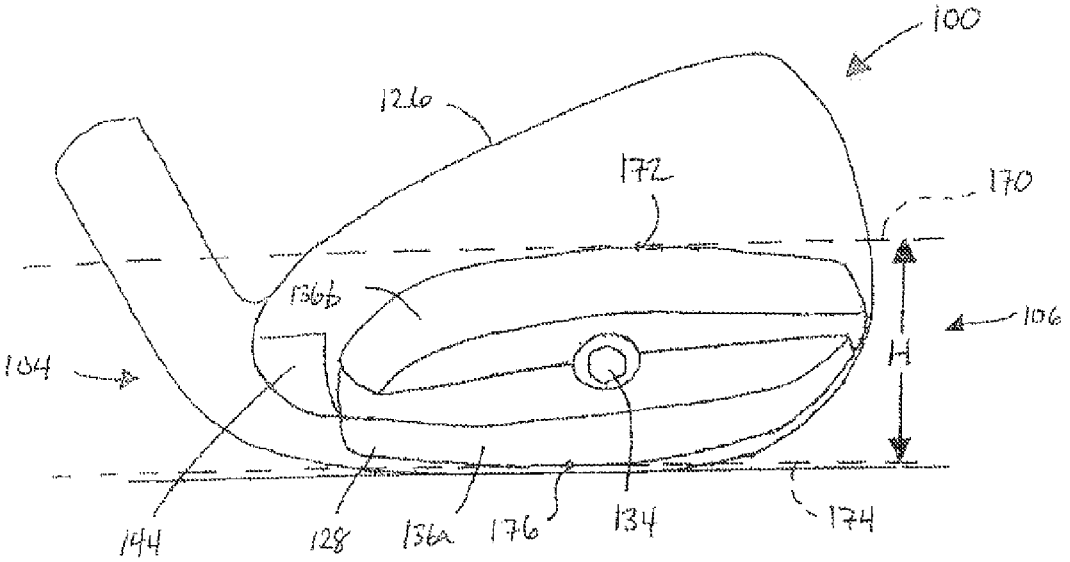
FIG. 12 is a rear perspective view of the golf club head of FIG. 4 with its face in the drawing plane.

Referring to FIG. 12, when the club head 100 is rotated from the reference position relative to a horizontal axis, normal to the center plane 147, so that the front surface (not shown) is vertical, the secondary component 128, in either the first or the second orientation, has a height H, characterized as the shortest distance between an upper imaginary horizontal plane 170, perpendicular to the front surface (not shown) and passing through a top-most point 172 of the secondary component 128, and a lower imaginary horizontal plane 174, perpendicular to the front surface (not shown) and passing through a bottom-most point 176 of the secondary component 128.

Figure 13:
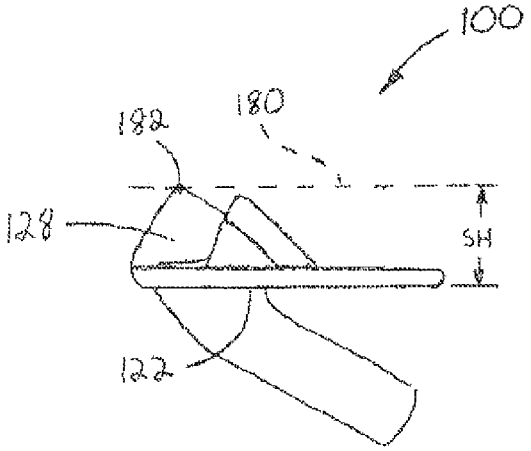
FIG. 13 is a toe-side elevational view of the golf club head of FIG. 4.

Referring to FIG. 13, "sole height", e.g., a sole height SH, as used herein, is the shortest distance between the front surface 122 of the golf club head and an imaginary plane 180, parallel to the front surface 122 and containing the rear-most point 182 of the secondary component 128. The rear-most point 182 is the point on the secondary component 128 that is the furthest orthogonal distance from the front surface 122 of the strike face.

Figure 14:
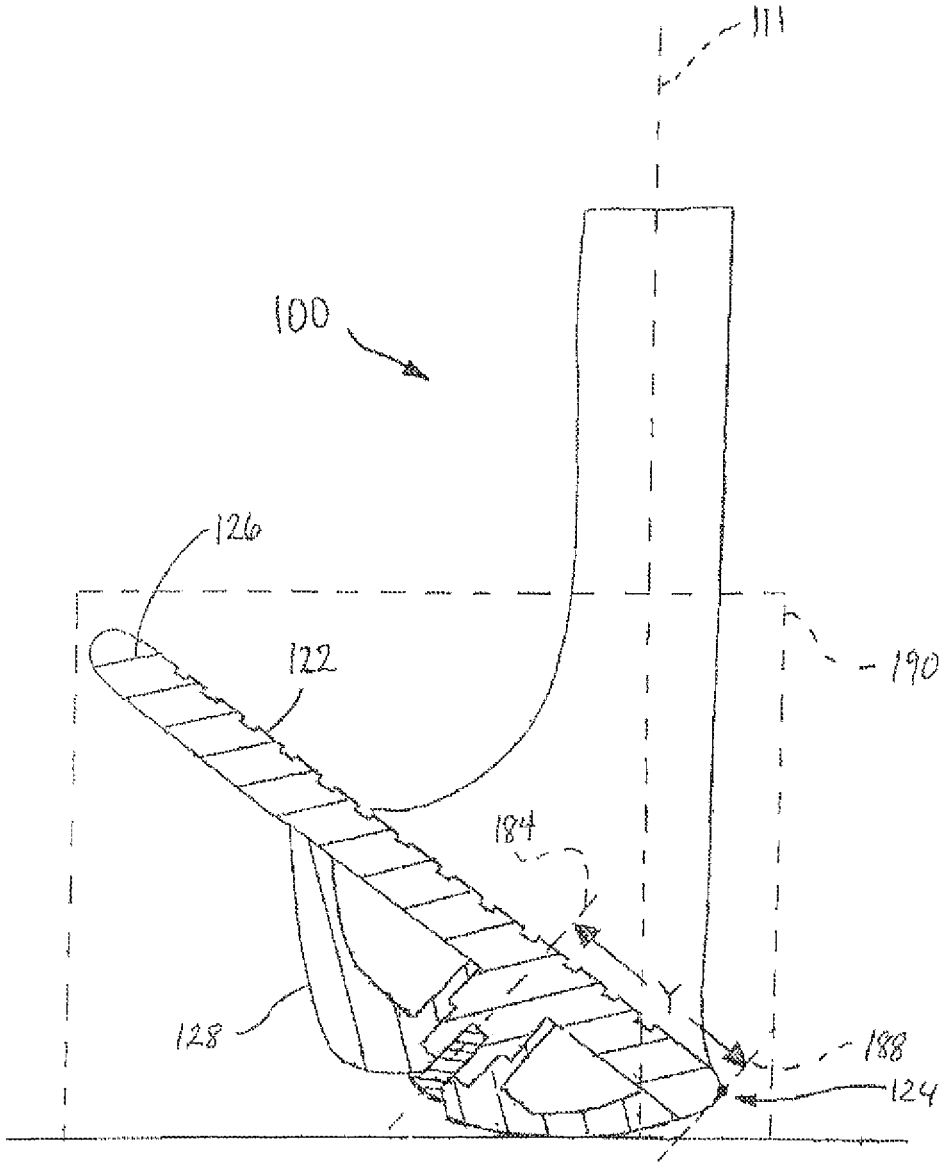
FIG. 14 is a toe-side cross-sectional view of the golf club head of FIG. 4.

Referring to FIG. 14, the secondary component 128 pivots about an axis of rotation 184, which is located a "first distance" Y from the leading edge 124 of the golf club head. With the club head 100 in the reference position, the first distance Y is characterized as the shortest distance between the axis of rotation 184 of the secondary component 128 and an imaginary line 188, parallel to the axis of rotation 184, passing through the leading edge 124, and located in an imaginary vertical face plane 190, substantially perpendicular to the hosel plane 111 and containing the axis of rotation 184.

Figure 15:
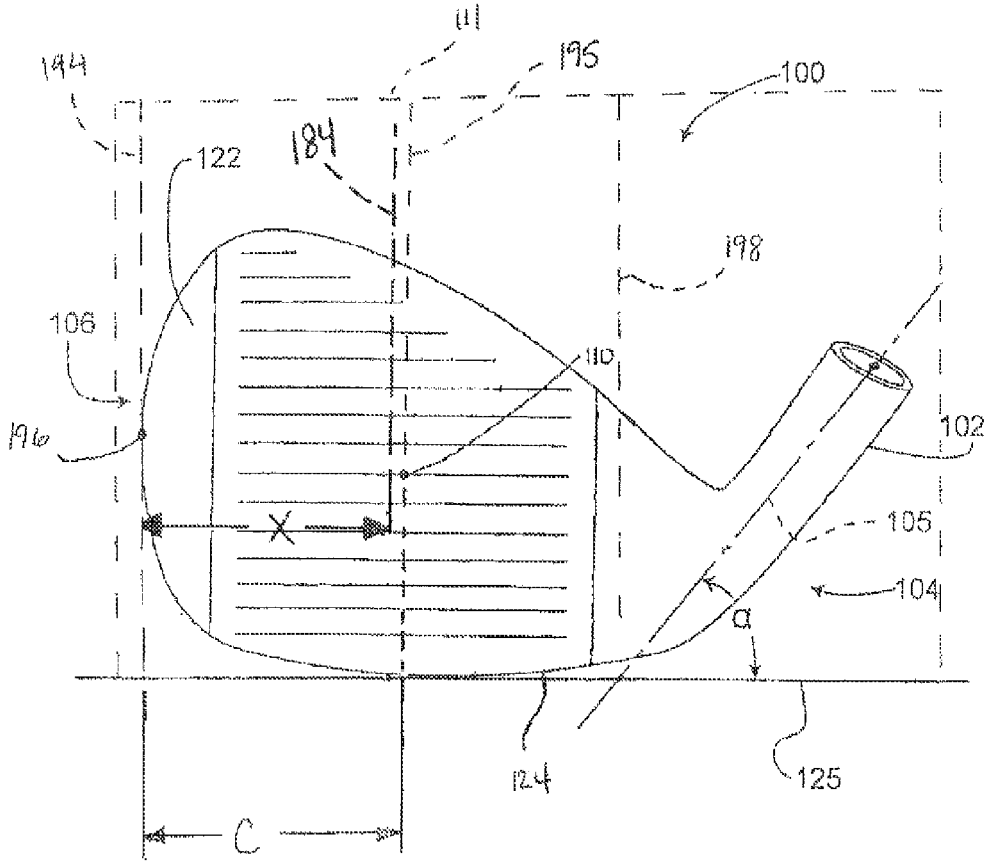
FIG. 15 is a front elevational view of the golf club head of FIG. 4.

Referring to FIG. 15, the axis of rotation 184 is located a "second distance" X from an imaginary vertical toe plane 194, perpendicular to the hosel plane 111 (see FIG. 14) and passing through the furthest laterally projecting toe point 196 of the club head. The second distance X is the shortest distance between the imaginary vertical toe plane 194 and the axis of rotation 184 of the secondary component 128, with the golf club head 100 in the reference position.

Figure 8:
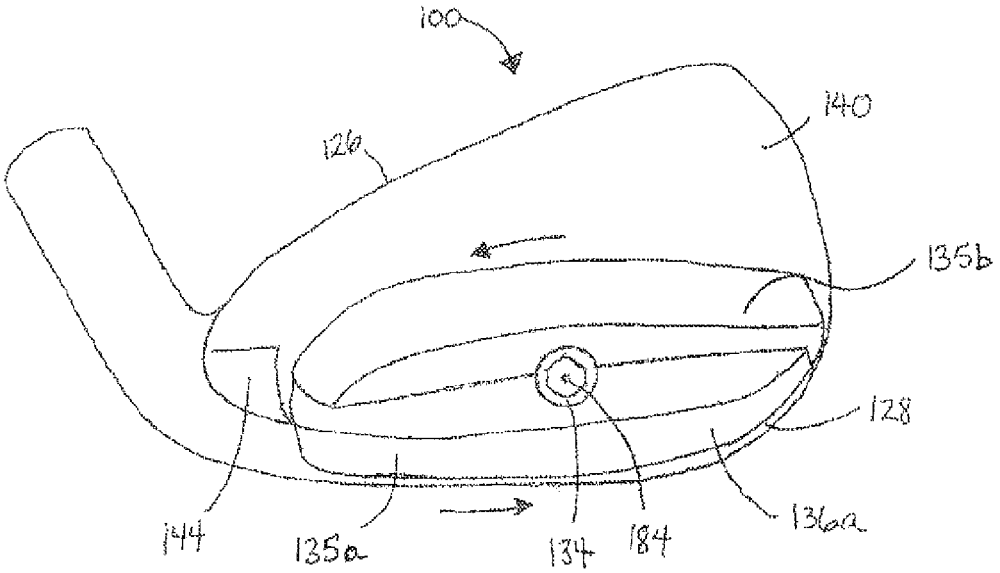
FIG. 8 is a rear perspective view of the golf club head of FIG. 4 with its face in the drawing plane.
Figure 9:
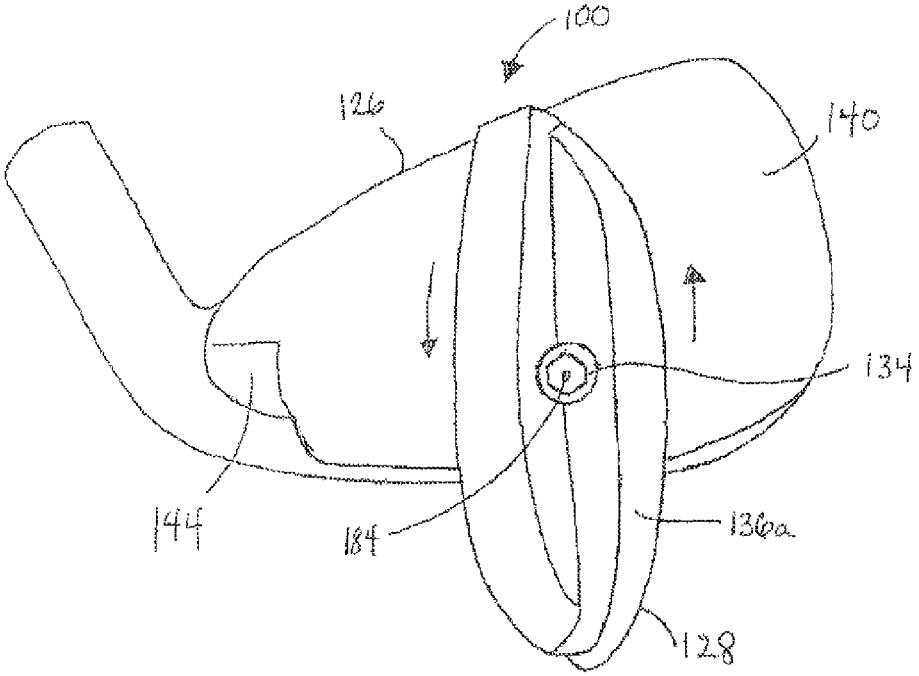
FIG. 9 is a rear perspective view of the golf club head of FIG. 4 with its face in the drawing plane.
Figure 10:
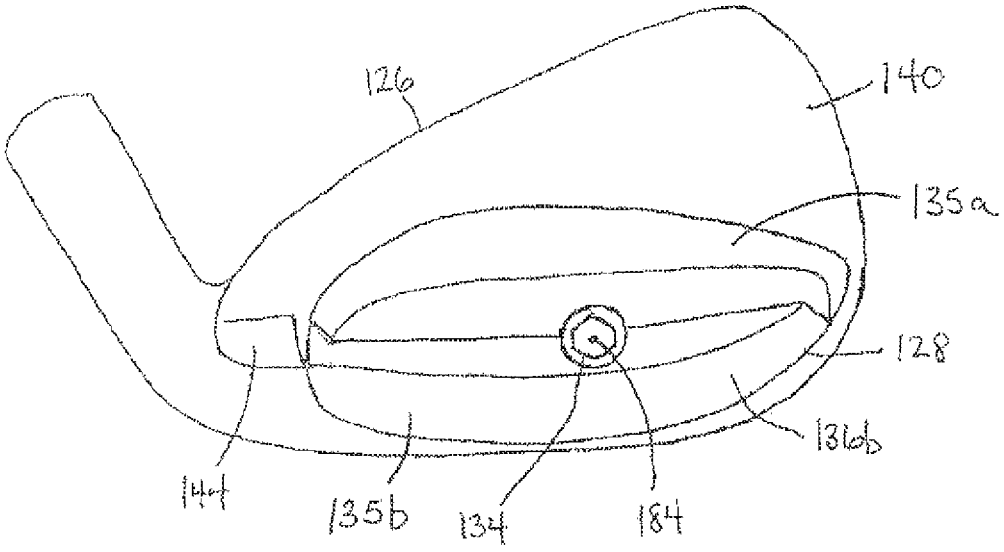
FIG. 10 is a rear perspective view of the golf club head of FIG. 4 with its face in the drawing plane.

Referring to FIG. 4, a golf club head 100, according to one or more aspects of the present invention, includes a primary component 126 pivotally associated with a secondary component 128. In one or more embodiments, the orientation or position of the secondary component 128 relative to the primary component 126 may affect the feel and/or play of the club head. For instance, the secondary component 128 may include a plurality of sole contour options, whereby each sole contour is designed for a particular course condition. More specifically, the secondary component 128 may have two or more sole contours which differ in, e.g., bounce, sole width, camber, sole height, or any combination thereof. As shown in FIGS. 8-10, a player may adjust the sole 108 of the club head 100 by rotating the secondary component 128, i.e., from a first position to a second position, relative to the primary component 128. Accordingly, a player may modify the bounce or other parameter of the club head 100 by using a single club, thus obviating the need to acquire or carry multiple clubs to accommodate varying golf course conditions and/or to provide a proper a club fitting.

Figure 6:
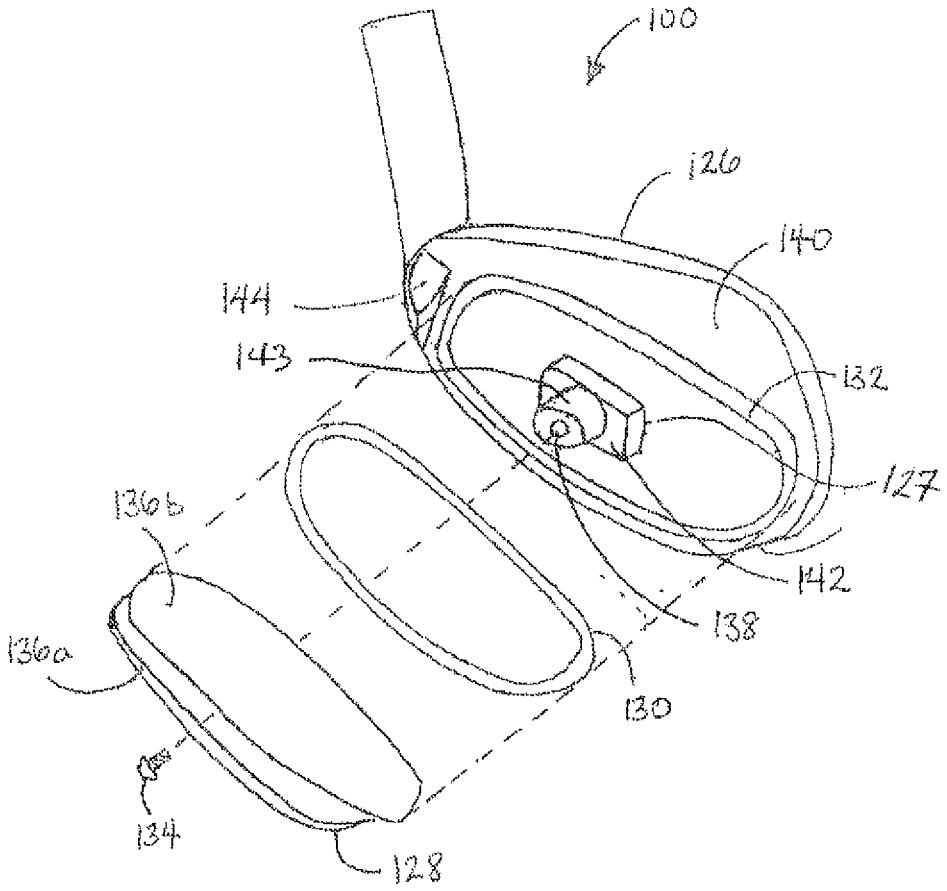
FIG. 6 is an exploded view of the golf club head of FIG. 5*a*.

As illustrated in FIG. 6, the primary component 126 of the golf club head 100 includes the strike face (not shown) and a rear surface 140. The rear surface 140 of the primary component 126 includes a means for mounting, joining, and/or coupling the secondary component 128 with the primary component 126. For example, the primary component 126 may have at least one mounting element 142 comprising a projection 143 with a bore 138 for receiving a fastener 134, e.g., a screw or pin, to couple the secondary component 128 to the primary component 126. In another example, a combination of different sized projections, bores, fasteners, or any combination thereof may be utilized to couple at least a portion of the secondary component 128 with the primary component 126.

Figure 7:
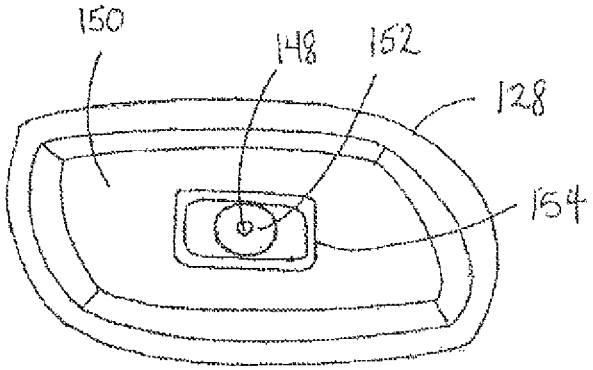
FIG. 7 is a front elevational view of a secondary component, according to one or more aspects of the present invention.

As shown in FIGS. 4, 6, and 7, the secondary component 128 may include a receiving element 154 having a complementary recess 152 located therein. The projection 143 of the mounting element 142 may engage the complementary recess 152 of the receiving element 154, thus allowing a portion of the secondary component 128 to abut the rear surface 140 of the primary component 126. Alternatively, the mounting element 142 may further include a seat 127 that protrudes from the rear surface 140 of the primary component 126 and is integral with the projection 143. Accordingly, when the projection 143 engages the complementary recess 152 of the secondary component 128, the secondary component 128 may abut the seat 127 and a gap may separate the rear surface 140 of the primary component 126 from the secondary component 128. Preferably, the gap is wide enough to accommodate a gasket 130, as shown in FIG. 5*a*. Referring to FIGS. 5*a* and 6, the rear surface 140 of the primary component 126 may further include a channel 132 for receiving the gasket 130. The gasket 130 arrangement allows for abatement of unfavorable vibrational and acoustical responses, associated, e.g., with ball impact.

Figure 4A:
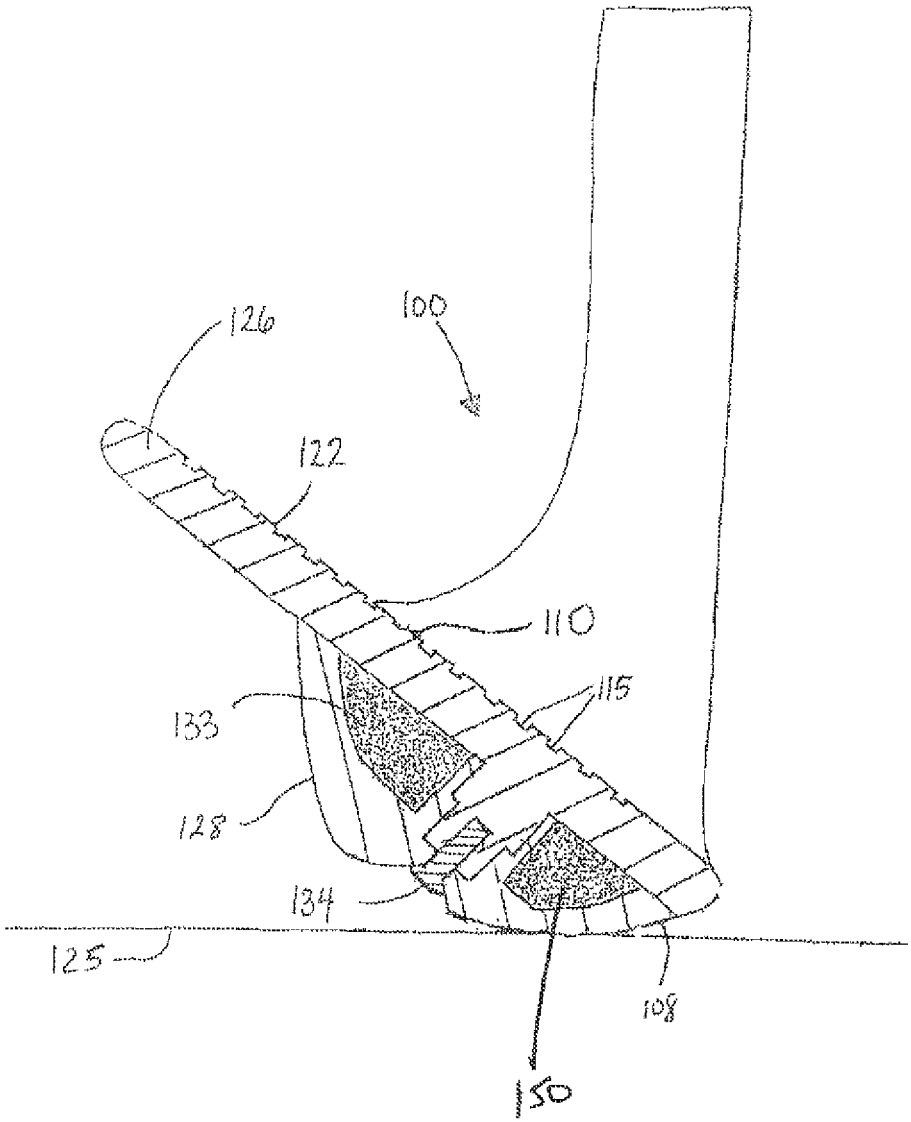
FIG. 4*a* is a toe-side cross-sectional view of the golf club head of FIG. 1, according to one or more aspects of the present invention.

Referring to FIGS. 4*a* and 7, the secondary component 128 may further include at least one cavity 150 that at least partially surrounds the receiving element 154. In one ore more aspects of the present invention, a weighting element may be positioned within the at least one cavity 150 to improve the mass properties of the golf club head 100 and/or to orient the center of gravity in a more favorable location. Alternatively or additionally, a damping material 133 may be placed, or optionally removably placed, within the at least one cavity 150 to improve club head feedback and acoustical properties. This allows the player to further modify the club head 100 to accommodate a particular course condition.

As described above, the secondary component 128 may be adjustable between a first orientation and a second orientation relative to the primary component 126. Referring to FIG. 8, the secondary component 128 may include a primary surface 135*a* and an auxiliary surface 135*b*. The primary surface 135*a* may be separated from the auxiliary surface 135*b* by a groove 156. When the secondary component 128 is in the first orientation (see FIG. 8), the primary surface 135*a* provides the golf club head 100 with a first sole contour 136*a*. When the secondary component 128 is in the second orientation (see FIG. 10), the auxiliary surface 135*b* provides the golf club head 100 with a second sole contour 136*b*. In one example, the first sole contour may be different from the second sole contour. Preferably, when the secondary component 128 is in the first orientation, the first sole contour is configured such that the golf club head 100 has a first bounce angle between about 2° and about 20°, more preferably between about 8° and about 18°, and most preferably between about 10° and about 18°. Preferably, when the secondary component 128 is in the second orientation, the second sole contour is configured such that the golf club head 100 has a second bounce angle between about 2° and about 20°, more preferably between about 12° and about 18°, and most preferably between about 14° and about 18°. Alternatively, the first sole contour may be the same as the second sole contour to improve club head longevity.

Figure 5:
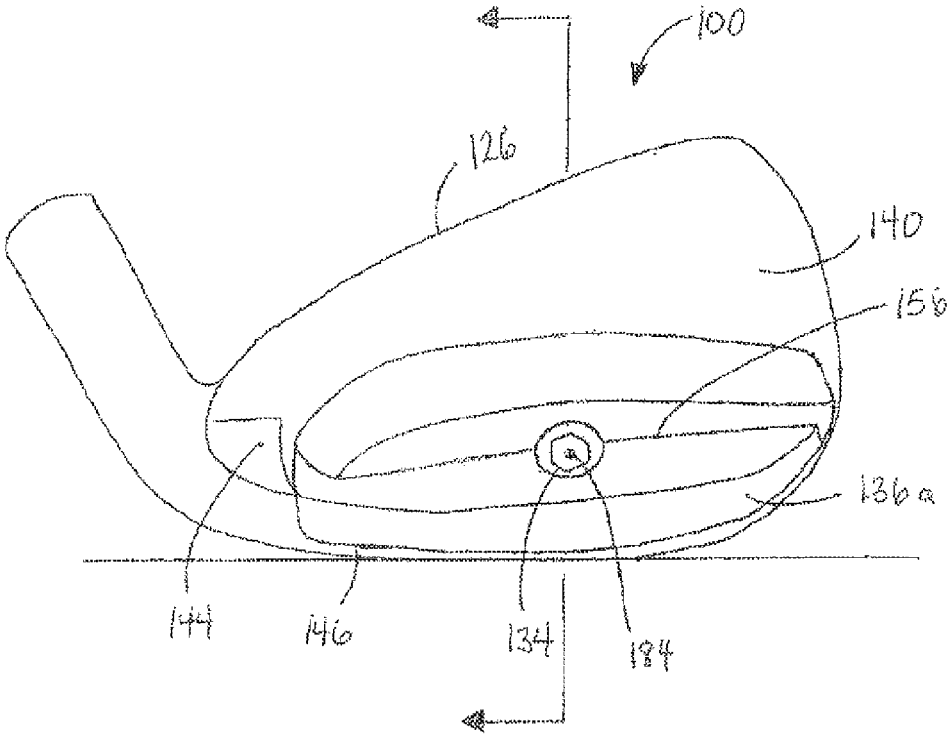
FIG. 5 is a rear perspective view of the golf club head of FIG. 1, according to one or more aspects of the present invention, with its face in the drawing plane.
Figure 5A:
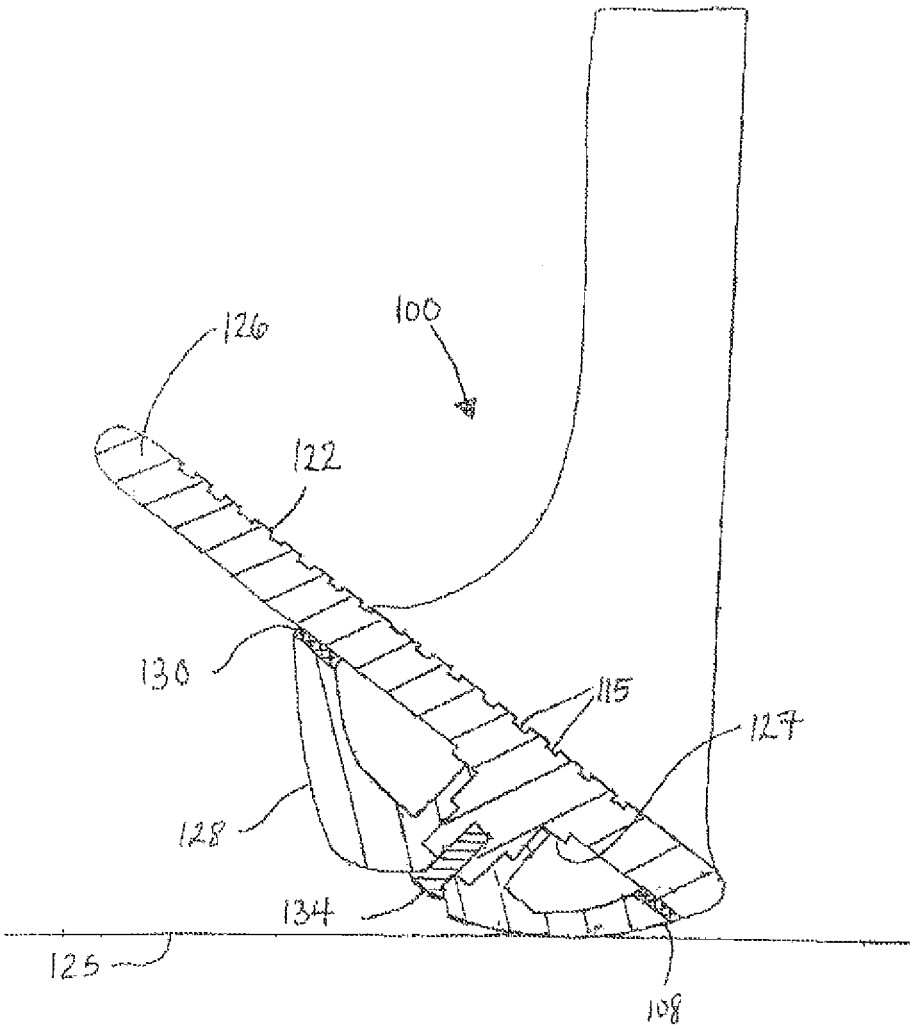
FIG. 5*a* is a toe-side cross-sectional view of the golf club head of FIG. 1, according to one or more aspects of the present invention.

Referring to FIG. 5, the primary component 126 further includes a heel flange 144. In one example, the primary surface 135*a* of the secondary component 128 may abut the heel flange 144 to provide the golf club head with an aesthetically pleasing design. Additionally, the secondary component 128 may be mounted on the primary component 126 such that the secondary component 128 is substantially flush with the strike face 122 of the primary component 126. Alternatively, the secondary component 128 may be mounted on the primary component 126 such that the secondary component 128 is spaced away from the leading edge 124 by a forward sole portion 146.

As described above, the primary component 126 is pivotally associated with the secondary component 128 via a fastener 134 having an axis of rotation 184. The fastener 134 may comprise a hinge or a pivoting element, such as a threaded fastener. In one example, the fastener 134 passes through a hole 148 (see FIG. 7) in the secondary component 128 and engages a threaded bore 138 of the primary component 126 (see FIG. 6). When adjusting the secondary component 128 from the first orientation to the second orientation, the user may loosen the fastener 134 via a tool, e.g., a ratchet, to unseat the secondary component 128 from the primary component 126. The secondary component 128 is then pivoted about the axis of rotation 184 of the fastener 134, as shown in FIGS. 8 and 9, thus allowing for an efficient sole adjustment process.

Referring again to FIGS. 13 and 14, the axis of rotation 184 of the fastener 134 may be located in an imaginary vertical face plane 190, substantially perpendicular to an imaginary hosel plane 111. The axis of rotation 184 is located a distance Y from an imaginary line 188, substantially parallel to the axis of rotation 184, passing through the leading edge 124, and located in the imaginary vertical face plane 190, with the golf club head 100 in a reference position. The golf club head 100 may further include a sole height SH between about 0.25 inches and about 1.25 inches and preferably between about 0.25 inches and 0.75 inches. Preferably, the club head 100 satisfies the relationship: (0.7)·sole height·cos (bounce angle)≤Y≤2.0·sole height·cos (bounce angle). In another example, the golf club head 100 satisfies the relationship: (0.7)·sole height·cos (bounce angle)≤Y≤(2.0)·sole height·cos (bounce angle). In yet another example, the golf club head satisfies the relationship: (1.2)·sole height·cos (bounce angle)≤Y≤(1.5)·sole height·cos (bounce angle). The distance Y may be between about 0.25 inches and about 1.75 inches. Preferably, the distance Y may be between about 0.25 inches and about 1.50 inches. More preferably, the distance Y may be between about 0.5 inches and about 1.50 inches. Most preferably, the distance Y may be between about 0.5 inches and about 1.25 inches.

As shown in FIGS. 11 and 15, the axis of rotation 184 may be located a distance X from an imaginary vertical toe plane 194, substantially perpendicular to the hosel plane 111 and passing through the furthest laterally projecting toe point 196 of the golf club head 100. The secondary component 128 further includes a width W between about 2.50 inches and about 3.5 inches, preferably between about 2.75 inches and about 3.50 inches, more preferably between about 3.00 inches and about 3.50 inches, and most preferably between about 2.75 inches and about 3.25 inches. In one example, the golf club head 100 satisfies the relationship: 0.3 W≤X≤0.7 W. In another example, the golf club head satisfies the relationship: 0.4 W≤X≤0.6 W. The distance X may be between about 1.00 inch and about 2.00 inches, preferably between about 1.00 inch and about 1.75 inches, and more preferably between about 1.25 inches and about 1.75 inches.

Referring to FIG. 12 the secondary component 128 of the golf club head 100 may also have a height H. Preferably, the height H is between about 0.75 inches and about 2.50 inches, more preferably between about 1.00 inch and about 2.00 inches, and most preferably between about 1.00 inch and about 1.75 inches.

Referring again to FIG. 15, the face center 110 is located a horizontal distance C from the imaginary vertical toe plane 194, when the golf club head 100 is in the reference position. In one embodiment, the distance X is not equal to the distance C. In another embodiment, the distance X is substantially the same as the distance C, whereby the axis of rotation 184 is located in an imaginary vertical center plane 195, passing through the face center 110 and perpendicular to the hosel plane 111. In yet another embodiment, the distance X is greater than the distance C. Preferably, the distance C is between about 1.00 inch and about 2.00 inches, preferably between about 1.00 inch and about 1.75 inches, and more preferably between about 1.25 inches and about 1.75 inches.

Figure 16:
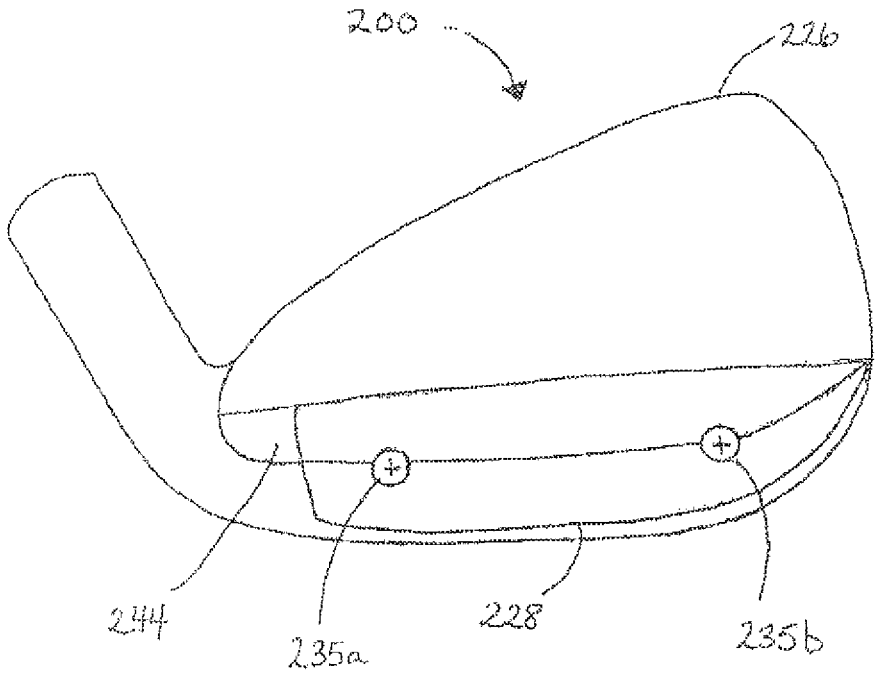
FIG. 16 is a rear perspective view of an exemplary golf club head, according to one or more aspects of the present invention, with its face in the drawing plane.
Figure 17:
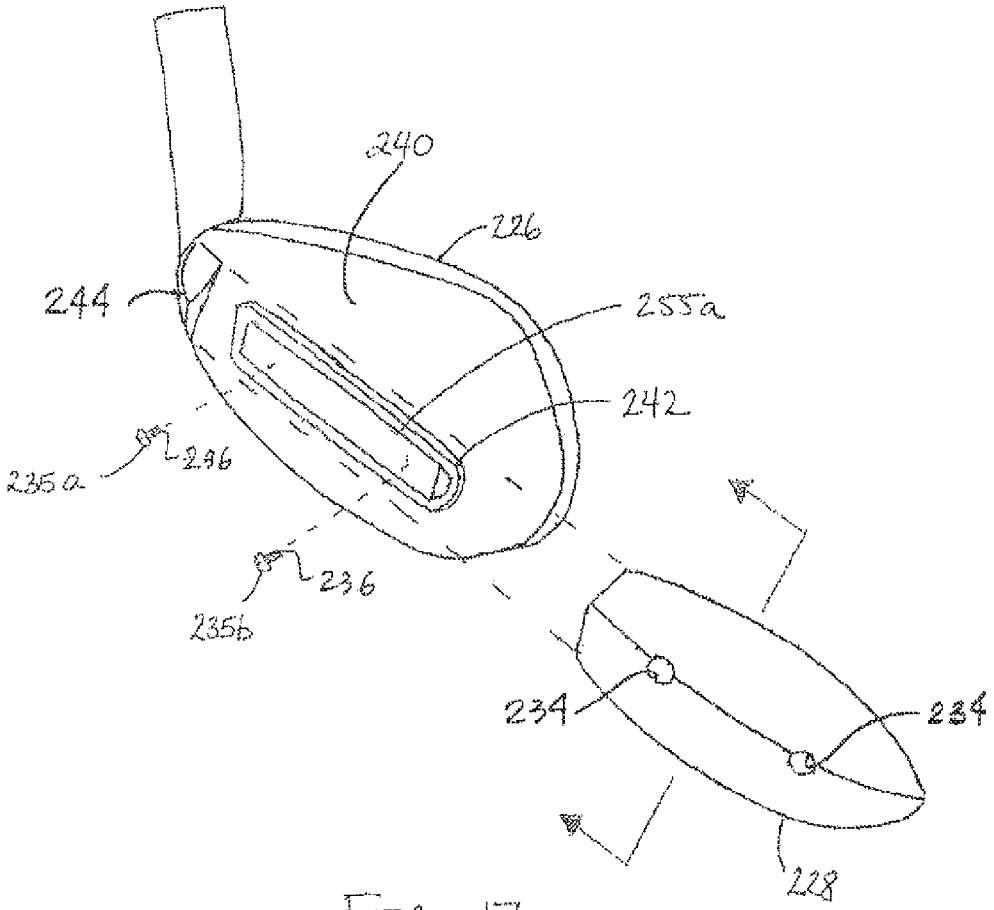
FIG. 17 is an exploded view of the golf club head of FIG. 16.
Figure 18:
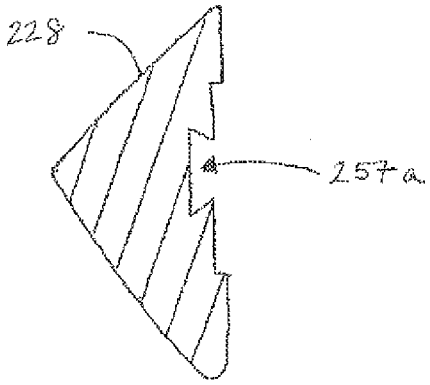
FIG. 18 is a cross-sectional view of an exemplary secondary component, according to one or more aspects of the present invention.

Referring to FIGS. 16-18, a golf club head 200, according to one or more aspects of the present invention, may include a primary component 226 removably associated with a secondary component 228. The primary component 226 includes a strike face (not shown) and a rear surface 240. A guide rail 255*a* projects from the rear surface 240 of the primary component 226 and provides a dovetail member along which the secondary component 228 may slidably engage with the primary component 228. For instance, the dovetail member of the primary component 226 may engage with a complementary dovetail slot 257*a*, located on the secondary component 228, to form a dovetail joint therebetween. Accordingly, to adjust the sole contour, a player would remove the secondary component 228 and replace it with a separate secondary component. The new secondary component may be selected from a plurality of options, whereby each secondary component is configured to form a distinct sole contour when secured to the primary component 226. Other shapes, profiles, or orientations of the means for joining the secondary component 228 with the primary component 226 are shown and/or described herein.

Figure 19:
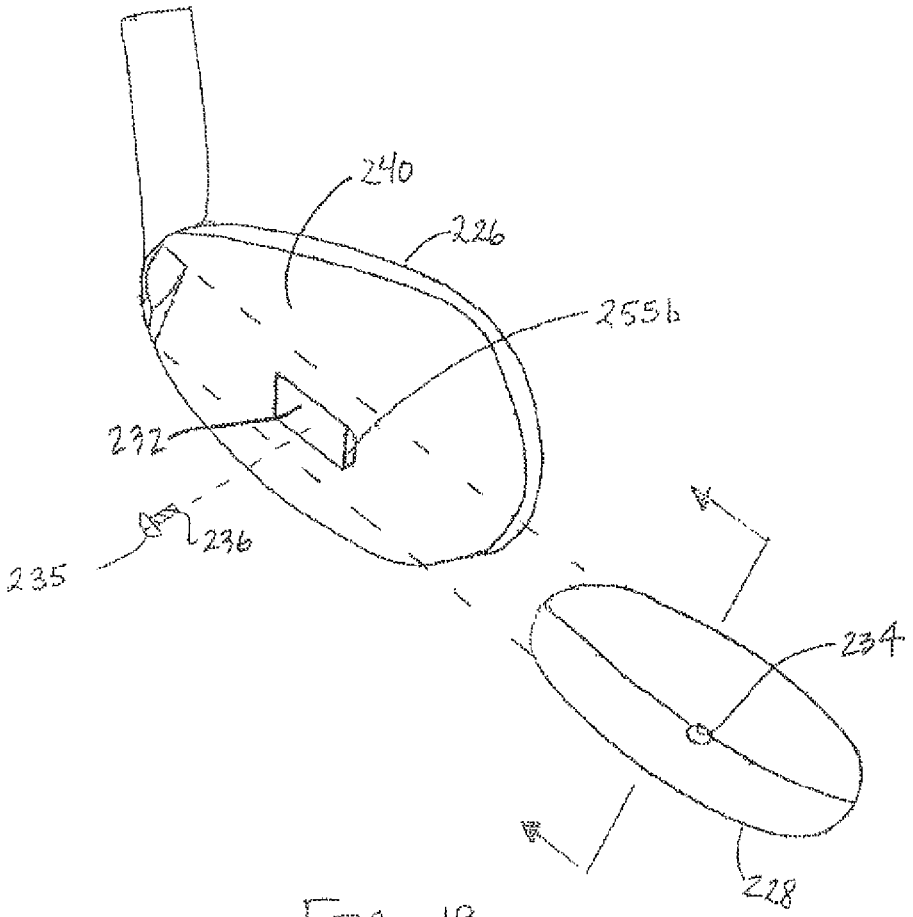
FIG. 19 is an exploded view of the golf club head of FIG. 16, according to one or more aspects of the present invention.
Figure 20:
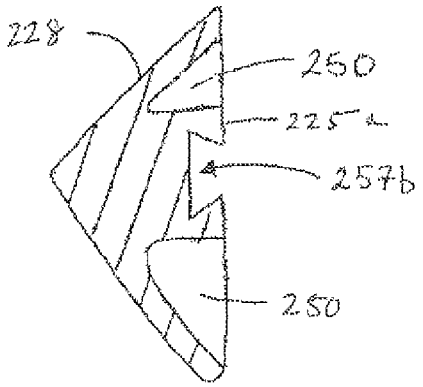
FIG. 20 is a cross-sectional view of an exemplary secondary component, according to one or more aspects of the present invention.
Figure 21:
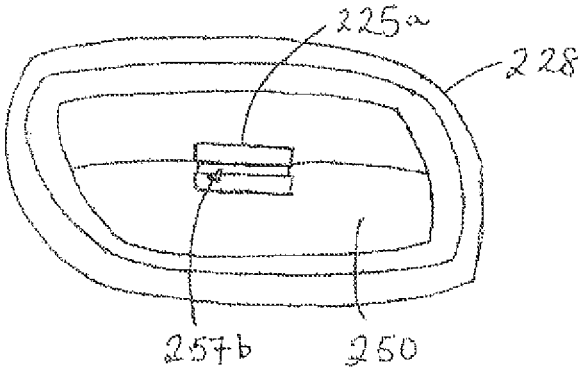
FIG. 21 is a front elevational view of the secondary component of FIG. 20.

Referring to FIGS. 19-21, the golf club head 200, according to one or more aspects of the present invention, may alternatively comprise a guide rail 255*b* having a truncated dove tail extending from the rear surface 240 of the primary component 226. The truncated dovetail member of the primary component 226 may engage with a complementary truncated dovetail slot 257*b*, located in a receiving element 225*a* of the secondary component 228, to form a dovetail joint therebetween. By utilizing the truncated dovetail, the secondary component 228 may be removed from the primary component 226, rotated or re-oriented, and replaced on the primary component 226. In a first orientation, the secondary component 228 may provide a first sole contour, and in a second orientation, the secondary component 228 may provide a second sole contour, without requiring a plurality of secondary components. In another example, a plurality of secondary components may be provided, whereby each secondary component has at least two sole contours thereon. Accordingly, the player may adjust the golf club head 200 based on preference, playing conditions, or for a fitting process. The secondary component 228 may abut a flange 244 of the primary component 226 to provide an aesthetically pleasing golf club head, while allowing the user to adjust the sole contour as discussed above.

The secondary component 228 may further include at least one cavity 250 that at least partially surrounds the receiving element 225*a*. Weights and/or damping material may be positioned in the at least one cavity 250 to improve mass properties and/or vibrational response, respectively. A gasket is optionally disposed between the primary component 226 and the secondary component 228.

Figure 22:
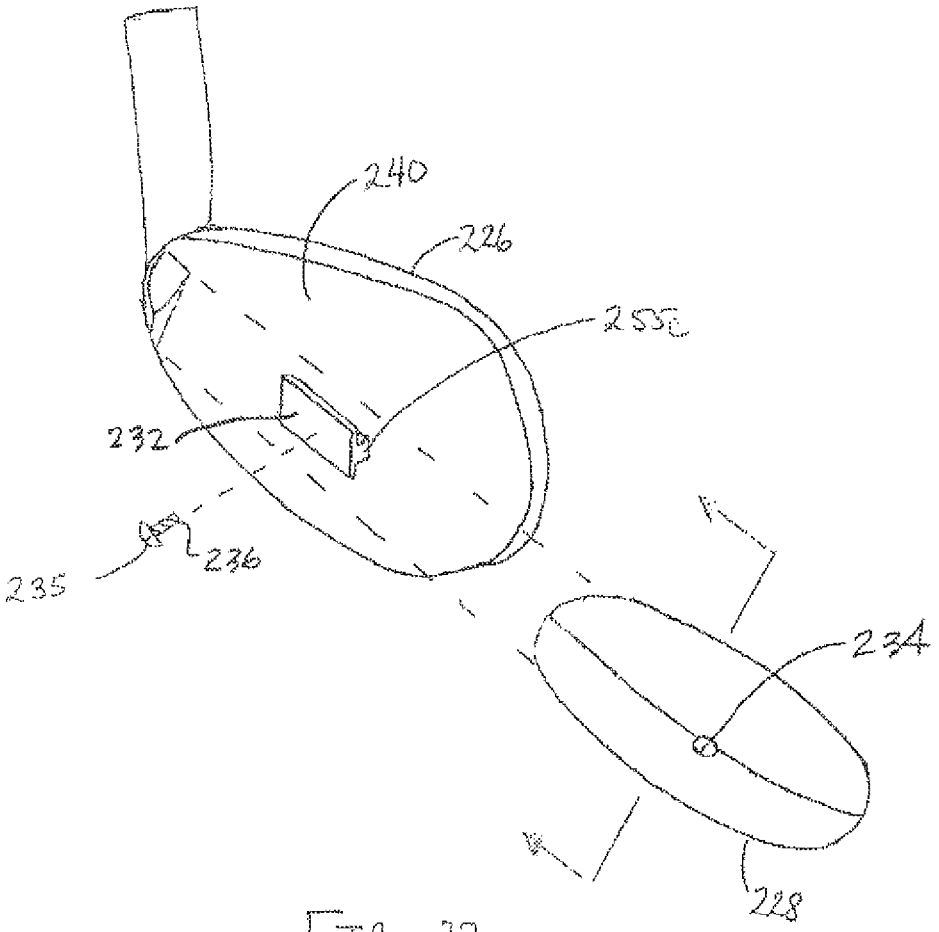
FIG. 22 is an exploded view of the golf club head of FIG. 16, according to one or more aspects of the present invention.
Figure 23:
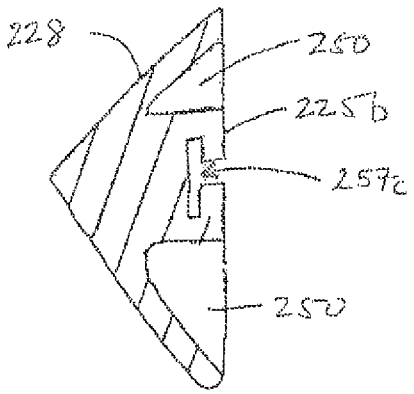
FIG. 23 is a cross-sectional view of an exemplary secondary component, according to one or more aspects of the present invention.
Figure 24:
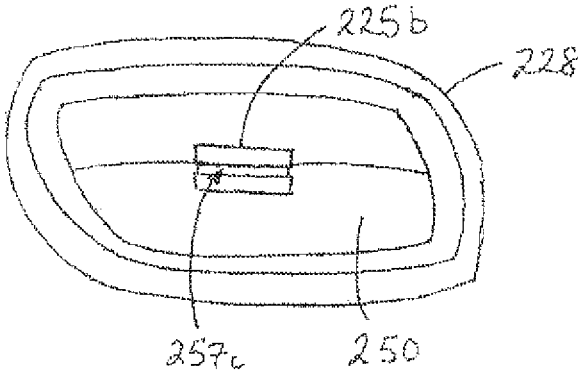
FIG. 24 is a front elevational view of the secondary component of FIG. 23.

Referring to FIGS. 22-24, the golf club head 200, according to one or more aspects of the present invention, may alternatively have a guide rail 255*c* comprising a truncated T-shaped projection that extends from the rear surface 240 of the primary component 226. The T-shaped projection of the primary component 226 may engage with a complementary T-shaped slot 257*c*, located in a receiving element 225*b* of the secondary component 228, to form a T-joint therebetween. As described above, the sole contour of the club head 200 may be modified by rotating or re-orienting the secondary component 228 from a first position, associated with a first sole contour, to a second position, associated with a second sole contour. It should be noted that, alternatively, the guide rails may be formed on the secondary component 228 and the receiving elements may be formed on the primary component 226.

With regard to each of the aspects of the present invention shown in FIGS. 17, 19, and 22, the secondary component 228 may be further secured to the primary component 226 by one or more securing elements, e.g., the securing elements 235, 235*a*, and 235*b*. Referring more specifically to FIG. 19, the secondary component 228 is provided with one or more threaded bores 234, which receives the securing element 235 therein. The securing element 235 may, e.g., comprise a threaded fastener or screw, and may include a tip 236. When the securing element 235 engages the threaded bore 234, the tip 236 of the securing element 235 pushes against the truncated dovetail member 255*b* of the primary component 226. Accordingly, the securing element 235 biases the secondary component 228 away from the rear surface 240 of the primary component 226, thus forming a tight fit between the truncated dovetail member 255*b* and the complementary truncated dovetail slot 257*b* of the secondary component 228.

The club heads, described herein, may be formed from a wide variety of materials, including metals, polymers, ceramics, composites, and wood. For instance, the club heads 100 and 200 may be made from stainless steel, titanium, or graphite fiber-reinforced epoxy, as well as persimmon or laminated maple. In one example, the club head may be formed, at least in part, of fiber-reinforced or fiberglass-reinforced plastic (FRP), otherwise known as reinforced thermoset plastic (RTP), reinforced thermoset resin (RTR), and glass-reinforced plastic (GRP).

It is to be understood that the above description is intended to be illustrative, and not restrictive. Many other embodiments will be apparent to those of skill in the art upon reviewing the above description. The scope should, therefore, be determined with reference to the appended claims, along with the full scope of equivalents to which such claims are entitled.

The invention claimed is:

1. A kit including:

a golf club head primary component comprising a strike face, a rear surface opposite the strike face, and a front sole surface;

a first golf club head secondary component and a second golf club head secondary component, the first and second secondary components interchangeably attachable to the primary component; and a securing member for coupling the first secondary component to the primary component in a first operating state, and associating the second secondary component to the primary component in a second operating state, in the first operating state, the primary component and the first secondary component defining a first bounce angle, and, in the second operating state, the primary component and the second secondary component defining a second bounce angle different from the first bounce angle, wherein:

the first golf club head secondary component comprises:

a first rear sole surface defining a first sole contour;

a first rearward surface adjacent to, and forming a junction with, the first rear sole surface; and a first aperture extending from the first rearward surface through the first secondary component, the first aperture adapted to receive the securing member therethrough; and the second golf club head secondary component comprises:

a second rear sole surface defining a second sole contour different from the first sole contour;

a second rearward surface adjacent to, and forming a junction with, the second rear sole surface; and a second aperture extending from the second rearward surface through the second secondary component, the second aperture adapted to receive the securing member therethrough.

2. The kit of claim 1, wherein at least one of the first aperture and the second aperture comprises a threaded portion.

3. The kit of claim 1, wherein the securing member comprises a threaded fastener.

4. The kit of claim 3, wherein, in at least one of the first operating state and the second operating state, the securing member comprises a forwardly-oriented longitudinal axis.

5. The kit of claim 1, wherein at least one of:

in the first operating state, the first secondary component further comprises a first forward surface abutting the rear surface of the primary component; and in the second operating state, the second secondary component further comprises a second forward surface abutting the rear surface of the primary component.

6. The kit of claim 5, wherein the rear surface of the primary component comprises a projection and at least one of:

the first forward surface of the first secondary component comprises a first recess having complementary structure to the projection; and the second forward surface of the second secondary component comprises a second recess having complementary structure to the projection.

7. A kit including:

a golf club head primary component comprising a strike face, a rear surface opposite the strike face, and a front sole surface;

a first golf club head secondary component and a second golf club head secondary component, the first and second secondary components interchangeably attachable to the primary component; and a threaded fastener for coupling the first secondary component to the primary component in a first operating state and associating the second secondary component to the primary component in a second operating state, the threaded fastener having a longitudinal axis, in the first operating state, the primary component and the first secondary component defining a first bounce angle, and, in the second operating state, the primary component and the second secondary component defining a second bounce angle different from the first bounce angle, wherein:

the first golf club head secondary component comprises:

a first rear sole surface defining a first sole contour;

a first aperture extending through the first secondary component and adapted to receive the threaded fastener therethrough such that, in the first operating state, the longitudinal axis of the fastener is forwardly-oriented; and the second golf club head secondary component comprises:

a second rear sole surface defining a second sole contour different from the first sole contour; and a second aperture extending through the second secondary component and adapted to receive the threaded fastener therethrough such that, in the second operating state, the longitudinal axis of the fastener is forwardly-oriented.

8. The kit of claim 7, wherein at least one of the first aperture and the second aperture comprises a threaded portion.

9. The kit of claim 7, wherein, at least one of:

in the first operating state, the first secondary component further comprises a first forward surface abutting the rear surface of the primary component; and in the second operating state, the second secondary component further comprises a second forward surface abutting the rear surface of the primary component.

10. The kit of claim 9, wherein:

the rear surface of the primary component comprises a projection and at least one of:

the first forward surface of the first secondary component comprises a first recess having complementary structure to the projection; and the second forward surface of the second secondary component comprises a second recess having complementary structure to the projection.

* * * * *